US007108038B2

(12) United States Patent
Welfonder

(10) Patent No.: US 7,108,038 B2
(45) Date of Patent: Sep. 19, 2006

(54) CORD TENSIONER

(75) Inventor: Konrad Welfonder, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 170 days.

(21) Appl. No.: 10/777,377

(22) Filed: Feb. 11, 2004

(65) Prior Publication Data

US 2004/0159410 A1 Aug. 19, 2004

(30) Foreign Application Priority Data

Feb. 14, 2003 (EP) ..... 03075440

(51) Int. Cl.
*E06B 3/48* (2006.01)

(52) U.S. Cl. ..... 160/84.06; 160/172 R

(58) Field of Classification Search ..... 160/84.06, 160/172 R, 279, 277, 289, 322; 16/197, 16/199; 211/119.15, 119.09; 267/69–74
See application file for complete search history.

(56) References Cited

U.S. PATENT DOCUMENTS

| | | | | |
|---|---|---|---|---|
| 950,952 | A | 3/1910 | Perrott | |
| 2,830,808 | A | 4/1958 | Graber | |
| 3,112,103 | A | 11/1963 | Falkenberg | |
| 3,151,857 | A | 10/1964 | Falkenberg | |
| 3,294,153 | A | 12/1966 | Fountain | 160/168 |
| 3,590,900 | A | 7/1971 | Salzmann | 160/322 |
| 3,633,646 | A | 1/1972 | Zilver | 160/168 |
| 3,945,264 | A | 3/1976 | Falkenberg | |
| 4,406,519 | A * | 9/1983 | Shaw | 359/443 |
| 4,473,101 | A * | 9/1984 | Langeler | 160/84.06 |
| 4,557,309 | A | 12/1985 | Judkins | 160/84 R |
| 4,601,131 | A * | 7/1986 | Ozols | 49/206 |
| 4,732,202 | A | 3/1988 | Anderson | |
| 4,733,711 | A | 3/1988 | Schon | 160/84.1 |
| 4,811,466 | A | 3/1989 | Zubli | 24/115 G |
| 4,825,929 | A * | 5/1989 | Haines | 160/84.06 |
| 5,168,913 | A | 12/1992 | Haines | 160/168.1 |
| 5,275,222 | A | 1/1994 | Jelic et al. | 160/178.2 |
| 5,333,845 | A * | 8/1994 | Seiichi | 267/71 |
| D377,287 | S | 1/1997 | Biba | D6/581 |
| 5,752,558 | A | 5/1998 | Lin | |
| D395,973 | S | 7/1998 | Huang | D6/581 |
| 5,845,696 | A | 12/1998 | Chou | 160/178.1 |
| 5,904,198 | A | 5/1999 | Huang | 160/168.1 R |
| D428,292 | S | 7/2000 | Anderson | D65/581 |
| 6,098,970 | A | 8/2000 | Lowe | 267/179 |
| 6,367,785 | B1 * | 4/2002 | Nakabayashi et al. | 267/71 |
| 6,669,178 | B1 * | 12/2003 | Ookawara | 267/71 |
| 6,792,999 | B1 | 9/2004 | Cross et al. | |
| 2005/0101456 | A1 * | 5/2005 | Maria Franssen | 482/121 |

FOREIGN PATENT DOCUMENTS

| | | |
|---|---|---|
| EP | 0 699 268 | 1/1997 |
| EP | 1 447 516 A2 | 8/2004 |
| GB | 381894 | 1/1932 |

(Continued)

*Primary Examiner*—Blair M. Johnson
(74) *Attorney, Agent, or Firm*—Dorsey & Whitney LLP

(57) ABSTRACT

A cord tensioner for a guide cord of a cord-guided blind which has an upper rail, a lower rail and a blind material extending between the upper and lower rails and in which the upper rail, the lower rail or both is movable; the cord tensioner being attached to the upper or lower rail; and wherein the cord tensioner includes a compression spring and the guide cord engages the spring so that a pulling force on the guide cord compresses the spring.

10 Claims, 4 Drawing Sheets

FOREIGN PATENT DOCUMENTS

| | | |
|---|---|---|
| GB | 2 050 560 A | 1/1981 |
| JP | 60-88779 | 5/1985 |
| WO | WO 94/28279 A1 | 12/1994 |
| WO | WO 99/55553 | 11/1999 |

* cited by examiner

CORD TENSIONER

CROSS REFERENCE TO RELATED APPLICATION

This application claims priority to European patent application No. 03075440.2, filed 14 Feb. 2003, which is hereby incorporated by reference as if fully disclosed herein.

BACKGROUND OF THE INVENTION

1. Field of the Invention

This invention relates to a cord tensioner for a cord-guided covering for an architectural opening.

2. Description of the Relevant Art

Such a cord-guided covering can be a roller blind, a pleated blind, a venetian blind, or a combination of such blinds. And such a blind or combination of blinds can be mounted in an architectural opening such as e.g. a window or in a slanted window, such as a roof window.

Cord tensioners for cord-guided coverings have been conventionally used to keep the guide cords of the window coverings taut. One of the effects of the cord tensioners is that a movable rail such as a head, intermeditate or bottom rail, which slide along the cords, will be kept in place when they are not being operated. The movable rails are particularly kept from sliding down along the cords, under their own weight by the tension of the cords and the friction between the cords and the movable rails. In slanted windows, the taut cords prevent the fabrics and slats of window coverings from sagging downwardly away from the windows.

Cord tensioners traditionally are common type tension springs. Such tension spring type cord tensioners for guide cords of window coverings are described in U.S. Pat. No. 4,733,711 and U.S. Pat. No. 4,557,309. However, tension springs have the inherent problem that they can be over-stretched, particularly when movable rails of their window coverings are moved up or down abruptly, so as to stretch the guide cords. Such springs can then be over-tensioned before the movable rail starts to slide along the guide cords, since the springs will bear the sudden, though temporary, force. Also when in the life-time of a blind, the guide cords extend in length by wear and tear, and the cords have to be re-tensioned, generally the tension spring is pulled out further.

It has been known to protect a tension spring against over-tension by mounting a cord between the two spring ends, the cord having a length that is shorter than the maximum expanding length of the spring. A problem with this solution is that the cord must always too long for the spring in normal use, and the excess length can get easily snagged between the coils of the spring.

Another solution, described in EP 0,699,268, is to provide two looped cords that are slidably attached to opposite ends of a tension spring and two stops that are spaced apart from opposite ends of the tension spring to prevent the spring from being over-tensioned. A drawback of this solution is the need of providing extra space where the tension spring is placed. Also, since a single tension spring is generally used, the guide cords must be made as looped cords.

SUMMARY OF THE INVENTION

In accordance with this invention, a cord tensioner is provided for tensioning a guide cord of a cord-guided blind which has an upper rail, a lower rail and a blind material extending between the extending between the upper and lower rails and in which the upper rail, the lower rail or both is movable; the cord tensioner being attached to the upper or lower rail; wherein the cord tensioner includes a compression spring and the guide cord engages the spring so that a pulling force on the guide cord compresses the spring.

Advantageously, the cord tensioner also includes a housing containing the spring. It is especially advantageous that the housing include an abutment member, against which the spring can be compressed by the cord, when it is pulled. It is also especially advantageous that the housing also include a hollow longitudinally-extending interior space, in which the spring can expand longitudinally when not being pulled by the guide cord, and an opening, through which the cord can enter the interior space longitudinally, the abutment member being located within the opening.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
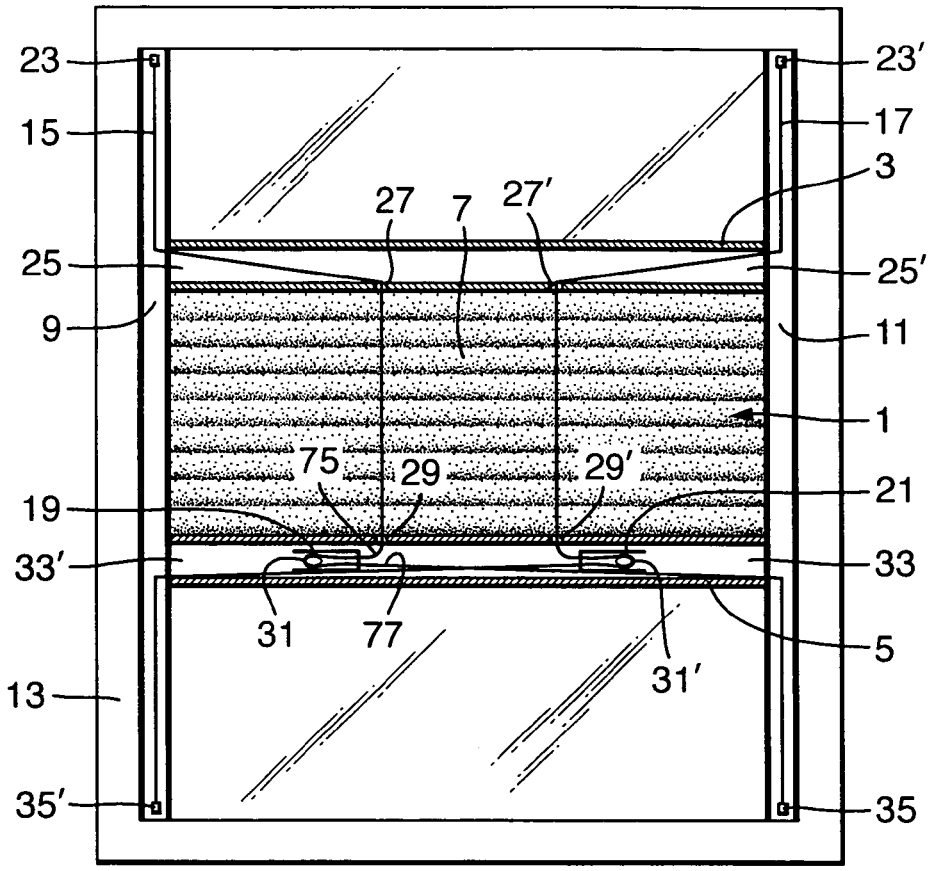
FIG. 1 is a schematic perspective view of a cord-guided pleated blind with two movable rails and two guide cords; shown in cross-section are two cord tensioners of a first embodiment of this invention, mounted in the lower rail.

FIG. 1 shows a cord-guided pleated blind 1 of the invention having a movable, longitudinally-extending hollow upper rail or bar 3, a movable, longitudinally-extending hollow lower rail or bar 5, and a pleated blind material 7 extending between the rails 3, 5. The blind 1 also has left and right, elongated side guides 9, 11 which are perpendicular to, and in front of, the rails 3, 5 and are also in front of left and right marginal portions of the blind material 7. The side guides 9, 11 are mounted in a window frame 13 which can be for a slanted roof window. The blind 1 has left and right, guide cords 15, 17 which are tensioned with left and right, cord tensioners 19, 21 and thereby hold the rails 3,5 in different vertical positions in the blind. The blind material 7 can be opened and closed by moving the upper and lower rails 3,5 vertically along the side guides 9, 11.

The cord tensioners 19,21 are mounted in the lower rail 5. The left guide cord 15 is routed from the top of the left side guide 9 to the bottom of the right side guide 11. The right guide cord 17 is routed as a mirror image of the left cord, from the top of the right side guide 9 to the bottom of the left side guide 11.

A top end 23 of the left guide cord 15 is attached to the top of the left side guide 9, and from there, the left guide cord extends downwardly along, and to the rear of, an upper part of the left side guide 11 and then extends to the right into the open left end of the upper rail 3. Inside the upper rail 3, the left guide cord 15 extends to the right, along a left part 25 of the length of the inside of the upper rail 3, towards the right side guide 11 and then extends downwardly through a first left opening 27 in the bottom of the upper rail. From the opening 27, the left guide cord 15 extends downwardly through or along the pleated blind material 7 and through a second left opening 29 in the top of the lower rail 5. Inside the lower rail 5, the left guide cord 15 extends to the left into the left cord tensioner 19 where it forms a leftward-extending loop 31, and then, the left guide cord extends to the right out of the right cord tensioner 21 and along a right part 33 of the inside of the lower rail 5, towards the right side guide 11. From the open right end of the lower rail 5, the left guide cord 15 extends downwardly along, and to the rear of, a lower part of the right side guide 11 to the bottom thereof, where the left guide cord is attached by its bottom end 35.

The right guide cord 17 is similarly routed through the blind 1 but in a mirror image. In this regard, a knotted top end 23' of the right guide cord 17 is attached to the top of right side guide 11, then the right guide cord extends downwardly along, and to the rear of, an upper part of the right side guide and then to the left into the open right end of the upper rail 3. Inside the upper rail 3, the right guide cord 17 extends to the left, along a right part 25' of the upper rail, towards the left side guide 9, until the right guide cord extends downwardly through a first right opening 27' in the bottom of the upper rail. Thereafter, the right guide cord 17 extends downwardly through or along the pleated blind material 7 and then into a second right opening 29' in the top of the lower rail 5. Inside the lower rail 5, the right guide cord 17 extends to the right into the right cord tensioner 21 where it forms a rightward-extending loop 31', and then, the right guide cord extends to the left out of the right cord tensioner 21 and along a left part 33' of the inside of the lower rail, towards the left side guide 19. From the open left end of the lower rail 5, the right guide cord 17 extends downwardly along, and to the rear of, a lower part of the left side guide 11 and to the bottom thereof, where the right guide cord is attached by its bottom end 35'.

Each cord tensioner 19,21 of the invention includes a compression spring 37, 37' which is put under tension when the ends 23, 35, 23', 35' of the guide cords 15, 17 are attached to the top and bottom of the side guides 9,11. The spring 37, 37' of each cord tensioner 19, 21 is adapted to maintain tension in the guide cord 15,17, which is looped within it, as the rails 3, 5 of the blind 1 are moved vertically. When a rail 3, 5 is moved upwardly or downwardly, it slides, together with the cord tensioners 19, 21 within it, along the guide cords 15, 17. As a result, the guide cords 15,17 move through the cord tensioners 19,21 and along the loops 31, 31' which the guide cords form within the cord tensioners.

Figure 2:
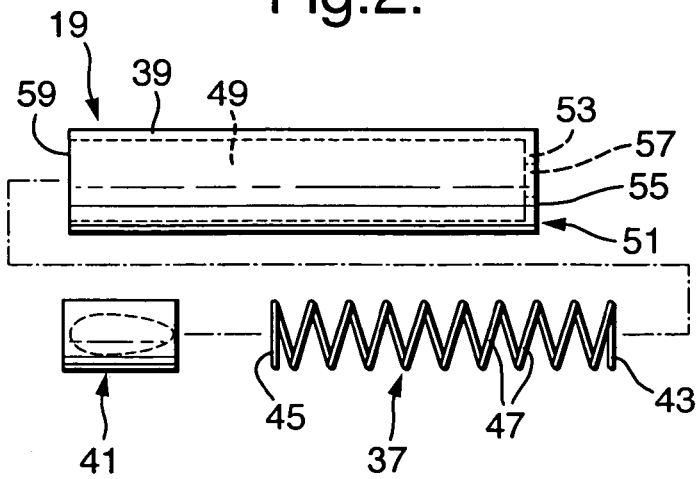
FIG. 2 is an exploded view of one of the cord tensioners of FIG. 1.
Figure 3:
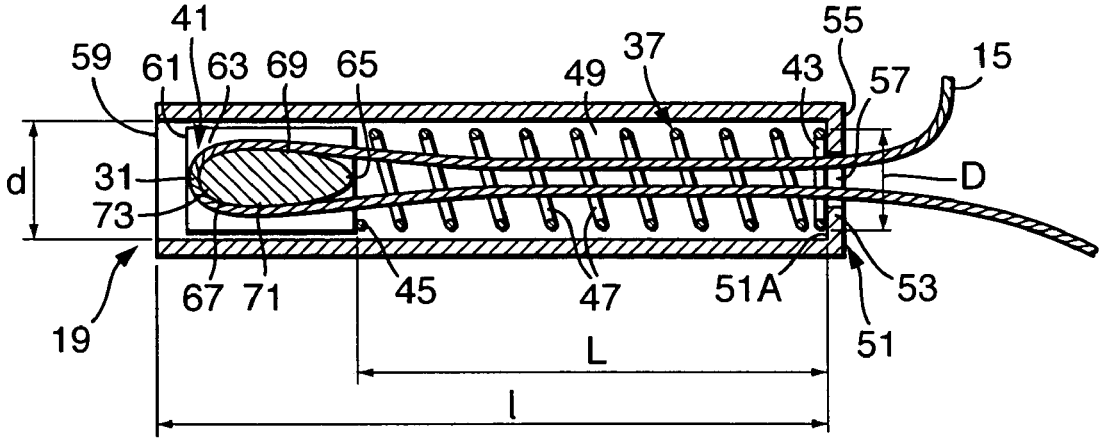
FIG. 3 is a cross-section of the cord tensioner of FIG. 2, showing its attachment to one of the guide cords and its compression spring in a relaxed state.
Figure 4:
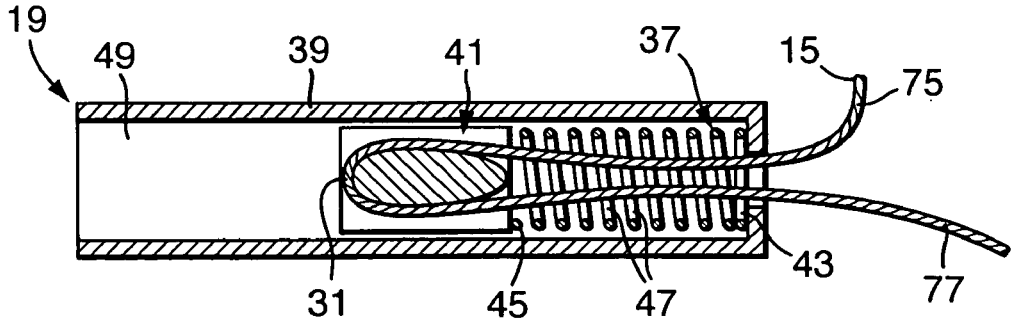
FIG. 4 is a cross-section of the cord tensioner of FIG. 2, with its compression spring partially compressed.

Since the left and right cord, tensioners 19,21 are identical and are mounted as mirror images in the lower rail 5 of the blind 1, FIGS. 2–4 show only the details of the left cord tensioner 19. The left cord tensioner 19 includes a longitudinally-extending spring 37, a generally cylindrical, spring housing 39 and a cord returner 41. The spring 37 is a common type compression spring, preferably of a helically-wound spring steel, having a first or right spring end 43, a second or left spring end 45, and a plurality of spring windings 47 extending longitudinally between the two spring ends 43,45. The spring housing 39 has an elongated, longitudinally-extending hollow interior space suited for containing the spring 37 and allowing it to be compressed and expand longitudinally. The hollow interior space 49 of the housing 39 is preferably a longitudinally-extending cylindrical space having an inner diameter (d) that is slightly larger than the diameter (D) of the compression spring 37 and of the cord returner 41 and a length (l) that is preferably somewhat larger than the length (L) of the spring 37 in its relaxed state plus the length of the cord returner 41.

The spring housing 39 of the left cord tensioner 19 includes an abutment member 51 which is perpendicular to the central longitudinal axis of the hollow interior space 49 and coaxial to it. The abutment member 51 is preferably shaped as an inturned rim 53 on an open right end 55 of the spring housing 39. The inturned rim 53 surrounds an opening 57 on the open right end 55, through which the left guide cord 15 (as shown in FIG. 1) move into and out of the hollow interior space 49 of the spring housing 39. The diameter of the opening 57 is smaller than the diameter of the spring 37. The abutment member 51 has an inner surface 51A which faces into the hollow interior space 49 of the housing 39 and against which the abutting right spring end 43 can abut when the spring 37 is being compressed.

The spring housing 39 also includes a left end 59 which preferably has a diameter equal to or larger than the diameter of the hollow interior space 49 of the housing 39, so as to allow the spring 37 to be inserted into the housing through the left end 59. Optionally, a closure cap (not shown) can be provided on the left end 59 after the spring 37 and the left guide cord 15 and cord returner 41 have been assembled within the hollow interior space 49 of the spring housing 39.

The cord returner 41 of the left cord tensioner 19, as shown in FIGS. 2–4, is preferably a longitudinally-extending, generally cylindrical member that can fit slidably in the hollow interior space 49 of the spring housing 39 to the left of the spring 37. The cord returner 41 has a first or left end 61, a longitudinally-elongate body 63, a second or right end 65, and a cord groove 67 which extends about the top, bottom and left sides of the cord returner. The right end 65 of the cord returner 41 rests against the left spring end 45. To this end, the diameter of the right end 65 of cord returner 41 is bigger than the diameter of the spring 37. This means that when the left guide cord 15 is pulled, causing it to be pulled to the right—outwardly of the spring housing 39—it pulls the left end 61 of the cord returner 41 to the right, which causes the right end 65 of the cord returner 41 to urge the left spring end 45 to the right, thereby compressing the spring 37 to the right against the inner surface 51A of the abutment member 51 of the housing 39—without the left guide cord pulling the cord returner 41 into the spring windings 47.

The cord groove 67 (shown in cross-section in FIGS. 3 and 4) of the cord returner 41 has a smooth, generally aerodynamic shape such as that of an aircraft wing. The cord groove 67 includes upper and lower, longitudinally-extending segments 69, 71 on its top and bottom. The upper and lower segments 69,71 are joined by a curved, concave-right, connecting segment 73 on the left end 63 of the cord returner 41. The upper and lower segments 69,71 extend gradually closer towards each other as they get closer to the right end 65 of the cord returner, and preferably the upper and lower segments converge at the right end 65. The surface of the cord groove 67 is sufficiently smooth and its diameter is sufficiently large, relative to the left guide cord 15, to allow the left guide cord to slide smoothly along it when the left guide cord is pulled by moving the upper or lower rail 3,5 vertically.

As seen particularly from FIGS. 3 and 4, the left guide cord 15 in the left cord tensioner 19 is slung around the cord returner 41 in a cord loop 31. The left side of the cord loop 31 is located in the connecting segment 73 of the cord returner 41, and adjacent leftward top and bottom portions 75,77 of the cord loop are located in the in upper and lower segments 69,71 of the cord returner. Rightward top and bottom portions 75,77 of the cord loop 31 extend longitudinally through the center of the compression spring 37 and to the right, out of the spring housing 39, through its cord opening 57. As seen from FIG. 1, the top loop portion 75 can be traced to the top end 23 of the left guide cord and the bottom lop portion 77 can easily be followed to the bottom end 35 of the left guide cord.

When the blind 1 is to be installed in a slanted roof window or the like, its guide cords 15, 17 are preferably routed already through its upper and lower rails 3, 5, its cord tensioners 19, 21 and its blind material 7. The top and bottom ends 23, 23', 35, 35' of the guide cords can then be attached to the top and bottom of the left and right side guides 9, 11 to put the guide cords under suitable tension during installation. For example, when the top ends 23,23' of the guide cords are attached first to the side guides and then the bottom ends 35, 35' are pulled downwardly in order to attach them to the side guides, the springs 37,37' of the cord tensioners are compressed. This is because, with reference to the left guide cord 15, such pulling forces act through its cord loop 31 on the cord returner 41 of the left cord tensioner 19. Since the cord returner 41 abuts against the left end of the spring 37 of the left cord tensioner and cannot slide into this spring, such pulling forces also act on the spring and compress it in its spring housings 39. Once a desired tension is reached in the guide cords 15, 17, the bottom cord ends 35, 35' are attached to the side guides. Thereby, the compression spring 37, 37' in each cord tensioner 19, 21 will be partially compressed. With reference to the left cord tensioner 19, since its spring 37 is biased to a relaxed state, the biasing force of the spring will push its cord returner 41 towards the left end 59 of the spring housing 39 and thus keep the left guide cord under tension. When the upper and/or lower rail 3,5 is subsequently moved up or down along the rear of the side guides 9, 11 under normal operating conditions, the springs 37, 37' of the cord tensioners 19, 21 will not be compressed further significantly. Also the relative position of the springs will reduce the possibilities of a skewed bottom rail when the rail is operated away from the center of the movable rail.

If, during the life of the blind 1, the guide cords 15, 17 stretch and become somewhat longer, the springs 37, 37' of the cord tensioners 19, 21 will also relax somewhat and the rails 3, 5 may tend to sag. However, the tension in the guide cords can be easily restored, simply by detaching one end of each guide cord, pulling the guide cord tighter, and then reattaching it so that its length is somewhat reduced. Thereby, each guide cord will be slightly shortened to about its original length and its spring will be compressed to its original partially compressed state.

Figure 5:
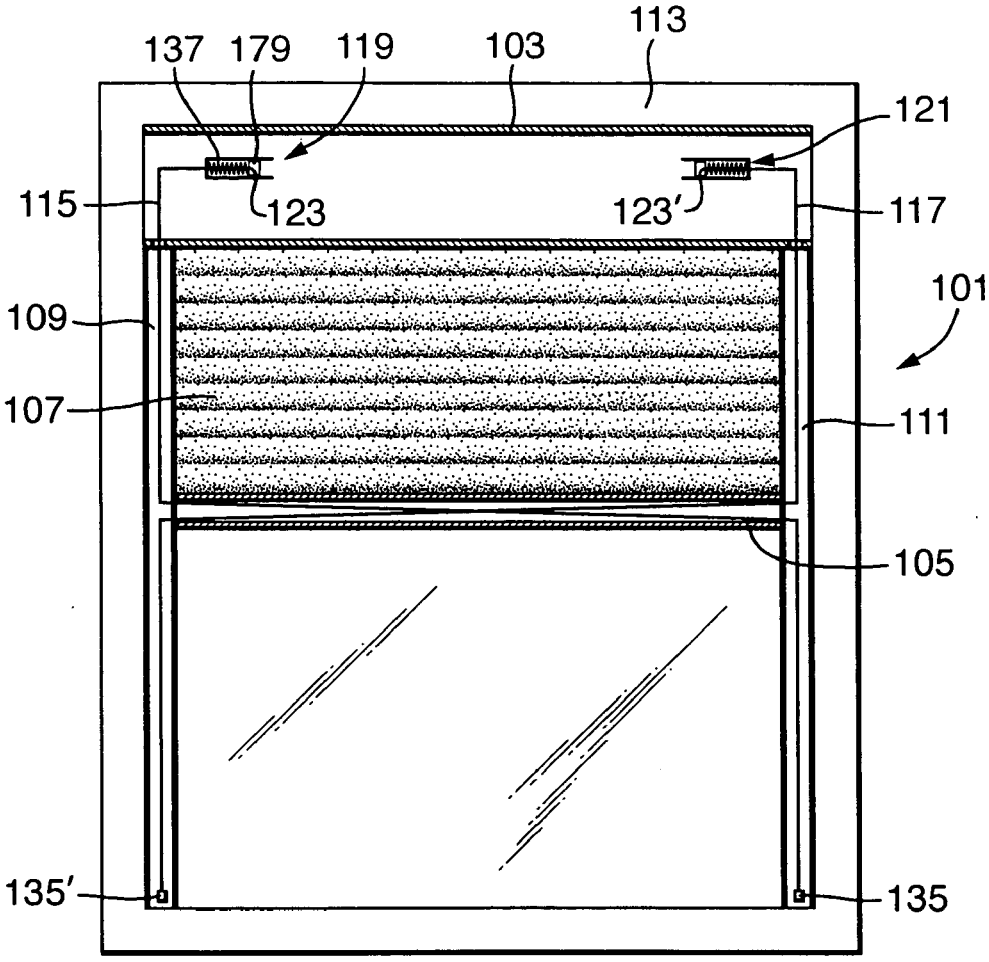
FIG. 5 is a schematic perspective view of a cord-guided blind with two guide cords, a fixed head rail and a movable bottom rail; shown in cross-section are two cord tensioners of a second embodiment of the cord tensioner of the invention, mounted in the head rail.
Figure 6:
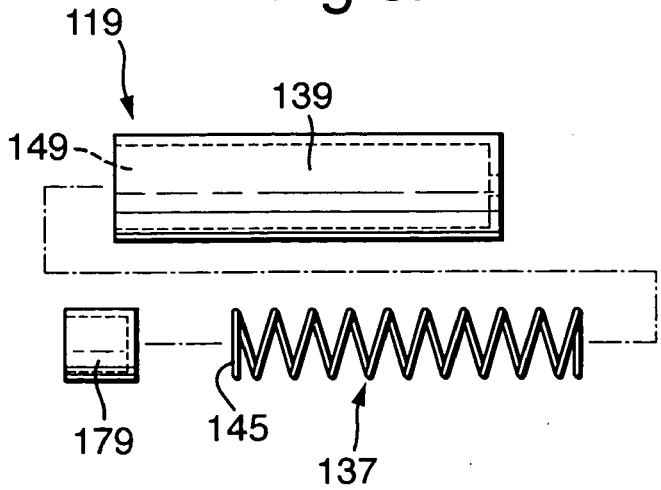
FIG. 6 is an exploded view of one of the cord tensioners of FIG. 5.
Figure 7:
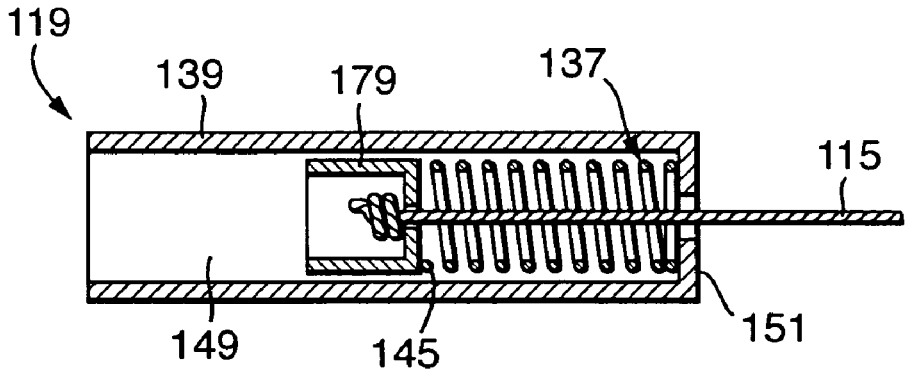
FIG. 7 is a cross-section of the cord tensioner of FIG. 6, showing its attachment to one of the guide cords and its compression spring in a partially compressed state.

FIGS. 5–7 show a second embodiment 101 of a cord-guided pleated blind of the invention which is similar to the blind 1 of FIGS. 1–4 and for which corresponding reference numerals (greater by 100) are used below for describing the same or corresponding parts.

The blind 101 has a fixed longitudinally-extending hollow head rail or upper rail 103, a movable longitudinally-extending hollow lower rail 105 and a roller blind material 107 extending between the rails. The blind also has left and right side guides 109, 111 which are mounted in a window frame 113, such as for a slanted roof window, left and right, guide cords 115, 117 which are tensioned with left and right cord tensioners 119, 121 in the head rail 103, and a roller mechanism (not shown) in the head rail 103 for raising and lowering the blind material 107 and thereby moving the lower rail 105 along the side guides 109, 111.

The routing of the left guide cord 115 is as follows: from the attachment of its top end 123 to the left cord tensioner 119 in the head rail 103, the left guide cord extends to the left towards the left side guide 109; then it extends downwardly along, and to the rear of, the left side guide 109 and downwardly through or along the left marginal portions of the blind material 107, which is also to the rear of the left side guide; then it extends to the right into the open right end of the lower rail 105; and then it extends to the right along the entire length of the lower rail 105. From the open right end of the lower rail 105, the left guide cord 115 extends downwardly along, and to the rear of, the right side guide 111, to the bottom thereof, where the left guide cord is attached by its knotted bottom end 135.

The right guide cord 117 is similarly routed through the blind 101 but in a mirror image. From the attachment of its top end 123' to the right cord tensioner 121 in the head rail 103, the right guide cord extends to the right towards the right side guide 111; then it extends downwardly along, and to the rear of, the right side guide and downwardly through or along the right marginal portions of the blind material 107, which is also to the rear of the right side guide; then it extends to the left into the open left end of the lower rail 105; and then it extends to the left along the entire length of the lower rail 105 where it crosses the left guide cord 115. From the open left end of the lower rail 105, the right guide cord 117 extends downwardly along, and to the rear of, the left side guide 109, to the bottom thereof, where the right guide cord is attached by its bottom end 135'.

Since the left and right cord tensioners 119, 121 are identical and are mounted as mirror images in the lower rail 105 of the blind 101, FIGS. 6–7 show only the left cord tensioner 119. The left cord tensioner 119 has a longitudinally-extending compression spring 137 within a spring housing 139. An abutment member 151, preferably shaped as an inturned rim 153, is provided on an open right end 155 of the spring housing 139. Instead of a cord returner, a cord keeper 179 is provided which is a longitudinally-extending, generally cylindrical member that can fit slidably in the hollow longitudinally-extending interior space 149 of the spring housing 139 to the left of the spring 137. The cord keeper 179 can suitably be of metal so that one longitudinal end of it can be crimped to the top cord end 123 of the left guide cord 115, or it can be of plastic with a longitudinally-extending central hole, through which the top cord end 123 can be threaded and then held in place with a knot. The diameter of the cord keeper 179 is larger than the diameter of the spring 137, so that the cord keeper abuts against the spring end 145 and cannot be pulled in to the spring by the left guide cord.

When the blind 101 of FIG. 5 is to be installed in a slanted roof window or the like, its guide cords 115, 117 are preferably already attached to the cord tensioners 119, 121 in the head rail 103 and are already routed along the side guides 109, 111, the blind material 107 and through the bottom rail 105 to its open ends. When subsequently attaching the free bottom ends 135, 135' of the guide cords to the bottom of the left and right side guides 109, 111, the guide cords can be put under tension.

Pulling the free bottom ends 135, 135' of the guide cords 115, 117, in order to attach them to the side guides, compresses the springs 137, 137' of the cord tensioners 119, 121 in head rail 103. This is because, with reference to the left cord tensioner 119, the pulling force acting on the left guide cord 115 acts through its top end 123 on its cord holder 179 and thereby on its spring 137. Since the cord keeper 179 abuts against its compression spring 137 and cannot slide into it, the force exerted on the left guide cord acts on the spring and compresses the spring.

Once the desired tension is reached in the bottom ends 135, 135' of the guide cords, they are attached to the bottom of the side guides 109, 111. With reference to the left cord tensioner 119, the compression spring 137 of each cord tensioner will then be partially compressed. Since the spring 137 is biased to a relaxed state, its biasing force will push its cord keeper 179 towards the open end of its spring housing 139 and thus keep the left guide cord under tension. When the bottom rail 105 is moved up or down, along the side guides 109, 111, under normal operating conditions, the spring will not be compressed significantly further.

If needed during the life of the blind 101, its guide cords 115, 117 can be conveniently retensioned if they have become longer.

Figure 8:
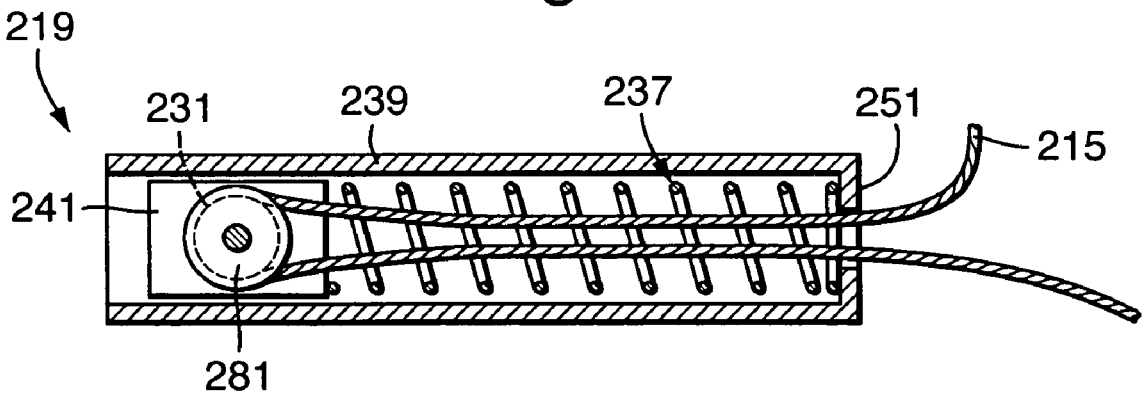
FIG. 8 is a cross-section, similar to FIG. 7, showing a third embodiment of the cord tensioner of the invention.

FIG. 8 shows a third embodiment 219 of a left cord tensioner of the invention for a cord-guided pleated blind which is similar to the left cord tensioner 19 of FIGS. 1–4 and for which corresponding reference numerals (greater by 200) are used below for describing the same or corresponding parts.

The left cord tensioner 219 has a spring housing 239 with a hollow longitudinally-extending interior space 249 that contains a longitudinally-extending compression spring 237 and a cord returner 241 to the left of the spring. An abutment surface 251 is provided on the open left end of the spring housing 239. The cord returner 241 has a pulley 281 around which is a loop of a left guide cord 215. The diameter of the hollow interior space 249 is larger than the diameter of the compression spring and the cord returner 241, so that spring and the cord returner can move freely therein in a longitudinal direction. The diameter of the cord returner 241 is also larger than the diameter of the spring, so that the cord returner abuts against the adjacent end of the spring when the cord returner is pulled longitudinally by the left guide cord 215. The cord pulley 281 facilitates the sliding of the left guide cord 215 around the cord returner 241 when the left guide cord 215 is pulled.

The cord tensioners 19, 21, 119, 121 and 219 of the invention can be used in any conventional cord-guided blinds for many different types of windows, without having to be redesigned. It may be necessary, for windows that are exceptionally steeply slanted and/or with bigger surfaces and/or for heavier blinds, to use a compression spring 37, 137, 237 that is bigger and stronger. It is of course well known that changes in diameter, number of windings, material used etc will result in different spring characteristics.

This invention is, of course, not limited to the above-described embodiments which may be modified without departing from the scope of the invention or sacrificing all of its advantages. In this regard, the terms in the foregoing description and the following claims, such as "vertical", "longitudinal", "perpendicular", "upwardly", "downwardly", "inner", "outer", "right", "left", "front", "rear", "top", "bottom", "upper" and "lower", have been used only as relative terms to describe the relationships of the various elements of the cord tensioner for a cord-guided window covering of the invention as shown in the Figures.

For example, kinematic inversions of the elements of the cord-guided windows, described above, are to be considered within the scope of the invention.

Also, the blinds 1, 101 can be provided with one or more additional movable longitudinally-extending rails and additional blind materials 7, 107, between the additional rails, and the guide cords 15, 17, 115, 117, 215 can pass longitudinally through the additional rails to guide vertical movement of the additional rails within the blinds. So that for example a roller blind can be combined with a pleated blind in the same window. Having a mutual intermediate bar. The pleated blind of such a composite blind can be cord guided, while the roller blind can be guided by side guides. The side guides for such a blind would preferably have a channel portion, and the free rims of the roller blind that are guided in the channel portion of the side guides can have side guiding pips preventing the roller blind material from escaping from the channel portions of the side guides. The roller blind can be at the top portion of the window and the pleated blind at the bottom. The blind at the top portion can also be a roller blind type insect screen.

Also the rails 3, 5, 103, 105 and any additional rails are not necessarily hollow, but can be longitudinally extending profiles that are open to front and back like e.g. a U-shaped profile or an I-shaped profile. The guide cords will than be routed along the open back of the rail profile, and the cord tensioner can be attached to the back of the profile. For example when the cord tensioner includes a cylindrical housing, the housing can be crimped in a longitudinally extending rim of the rail profile. The crimping entails that the rim or a portion thereof is folded over the cord tensioners housing using a special tool, keeping the cord tensioner in place.

Also the cord-guided blind in which the cord-tensioners of the invention are used, is not necessarily in a rectangular form. A blind for a triangular or a pentagonal shaped window can be used, as long as the blind is a cord guided blind.

Moreover, instead of attaching the ends 23, 23', 35, 35', 123, 123', 135, 135' of the guide cords 15, 17, 115, 117 to the side guides 9, 11, 109, 111, they can also be attached to the window frame. Also the cords can be attached to the side guides or to the window by using knots (pulling cord through a hole or an eyed pin and knotting it). Other cord attachment means, besides knots, can be used for attaching the ends of the guide cords to the side guides or to the window frame. Such as e.g. a cord plate on to the end of a cord, that co-operates with a part of the side guide, that is of course relatively easy the detach and re-attach.

Also, the abutment members 51, 151, 251 are preferably integrally formed with the spring housings 39, 139, 239 as inturned rims on open ends of the housings, but alternatively, an abutment cap member could be inserted in the open end of a spring housing. Of course, such an abutment cap would have to be securely fastened to the spring housing to prevent it from being pushed off of the spring housing by pulling forces on the guide cords.

The outer shape of the spring housing 39, 139, 239 is of no consequence to the operation of the cord tensioners 19, 21, 119, 121 and 219 of the invention. Thus any convenient shape can be chosen. Indeed, the spring housings can be integrally formed, wholly or partly, with the rails 3,5, 103, 105, in which the spring housings are located. A partly integrally-formed the spring housing could have a base cradle-like member shaped in the head rail and a counter-shaped cradle like cap member to be snapped to it, together forming the hollow interior space 49, 149, 249 and abutment surface 51, 151, 251 needed to for the compression spring 37, 137, 237. Alternatively, an integrally-formed spring housing can be as simple as a first hollow cylinder of a first diameter that conveniently accommodates the spring and an adjacent second hollow cylinder for leading the guide cord in and out of the housing and a spring abutment surface being provided between the two cylinders. Alternatively, a spring housing can be shaped by a trellises, possibly no more than two parallel, longitudinally extending trellises that are connected to circular end rings, one of the end rings having an inturned rim and thus forming an abutment surface. The opening between the trellises being such that the spring cannot pass between them.

I claim:

1. A blind comprising a longitudinally extending hollow upper rail having an open left end and an open opposite right end; and a longitudinally extending lower rail having an open left end and an open opposite right end; and a blind material attached to the upper rail and the lower rail and extendable between them and in which the upper rail, the lower rail or both are movable; and a left and a right guide cord extending parallel to each other from the upper rail to the lower rail, the left guide cord entering the lower rail by the left end and the right guide cord entering the lower rail by the right end, and wherein the first and second guide cords cross over in the lower rail such that the left guide cords exits the lower rail at the right end and the right guide cord exits the lower rail the left end; and each guide cord being operatively connected to a cord tensioner; wherein each cord tensioner comprises a compression spring through which the guide cord extends;

and wherein both cord tensioners are fixed in the upper rail or the lower rail of the blind each in a dedicated longitudinal position while allowing compression of the spring.

2. The blind of claim 1, wherein the cord tensioner further comprises a housing for containing the spring.

3. The blind of claim 2, wherein the housing comprises a hollow longitudinally-extending interior space having a diameter slightly larger than the spring in which the spring can be accommodated, an abutment member against which the spring can be compressed by the cord when it is tensioned, and an opening, through which the cord can enter the interior space longitudinally, the abutment member being located within the opening.

4. The blind of claim 3 wherein the interior space of the housing is cylindrical with a diameter greater than the diameter of the spring and a length that is at least equal to the length of the spring.

5. The blind of claim 3 wherein the abutment member is an inturned rim of the housing at a longitudinal end thereof.

6. The blind of claim 3, wherein the cord tensioner further comprises an attachment member for engaging the guide cord with the spring; the attachment member being mounted inside the housing in engagement with the spring and having a diameter larger than the diameter of the spring.

7. The blind of claim 6, wherein the attachment member includes longitudinally-extending cord grooves, along which the guide cord can slide longitudinally.

8. The blind of claim 6, wherein the attachment member includes a rotatable cord pulley.

9. The blind of any one of claims 1–8 wherein the cord tensioner is fixed in the upper rail and the upper rail is a fixed rail.

10. The blind of any one of claims 1–8 wherein the cord tensioner is fixed in the lower rail and the lower rail is a movable rail.

* * * * *